United States Patent [19]

Bar

[11] Patent Number: 4,784,583

[45] Date of Patent: Nov. 15, 1988

[54] RECIPROCATING HERMETIC MOTOR COMPRESSOR WITH A THERMETICALLY INSULATABLE NON-ROTATABLE MUFFLER

[75] Inventor: Alfredo Bar, Pavia, Italy

[73] Assignee: Necchi Compressori S.r.l., Pavia, Italy

[21] Appl. No.: 42,856

[22] Filed: Apr. 27, 1987

[30] Foreign Application Priority Data

May 22, 1986 [IT] Italy ..... 42909 A/86

[51] Int. Cl.[4] ..... F04B 39/00

[52] U.S. Cl. ..... 417/312; 181/403

[58] Field of Search ..... 417/312, 902; 181/240, 181/403

[56] References Cited

U.S. PATENT DOCUMENTS

| | | | |
|---|---|---|---|
| 3,817,661 | 6/1974 | Ingalls et al. | 181/240 |
| 4,313,715 | 2/1982 | Richardson, Jr. | 417/902 |
| 4,370,104 | 1/1983 | Nelson et al. | 417/902 |
| 4,401,418 | 8/1983 | Fritchman | 417/902 |
| 4,477,229 | 10/1984 | Kropinnicki et al. | 417/902 |

FOREIGN PATENT DOCUMENTS

| | | | |
|---|---|---|---|
| 0195486 | 9/1986 | European Pat. Off. | 417/312 |
| 0014878 | 2/1981 | Japan | 417/312 |
| 0060883 | 5/1981 | Japan | 417/571 |

*Primary Examiner*—Carlton K. Croyle
*Assistant Examiner*—Leonard P. Walnoha
*Attorney, Agent, or Firm*—Stevens, Davis, Miller & Mosher

[57] ABSTRACT

Reciprocating hermetic motor compressor wherein the head has only the delivery chamber and the suction muffler is directly fixed to the valve plate in such a way that a thermic exchange between the refrigerant sucked gas and the head is avoided.

2 Claims, 1 Drawing Sheet

RECIPROCATING HERMETIC MOTOR COMPRESSOR WITH A THERMETICALLY INSULATABLE NON-ROTATABLE MUFFLER

DISCLOSURE OF THE INVENTION

The present invention relates to a reciprocating hermetically sealed motor compressor comprising a driving electric motor, a frame, a cylinder positioned within the frame and in which a piston reciprocates, a valve placed at one end of the cylinder, a head which fixes the valve plate to the cylinder and a muffler on the suction portion. In the known reciprocating hermetically sealed motor compressors, the refrigerant gas, which arrives vaporized from in the shell, passes through a muffler into the suction chamber which is formed in the head, and from there, through the valve plate, where it is sucked into the cylinder. From the cylinder the compressed gas passes through the valve plate and arrives in the delivery chamber, formed in the head too, and from there sent to a condenser.

In compressing the gas, work is required, thus generating heat which is partially transmitted to the head by the gas in the delivery chamber. Since the delivery chamber is contiguous to the suction chamber, this chamber also gets hot, as the head is metallic. Thus the gas coming from the suction muffler absorbs heat before entering the cylinder. By heating the refrigerant gas in the suction chamber, the refrigerant gas increases its volume, thus the quantity of gas sucked into the cylinder is lower than the quantity of gas that would be sucked into the cylinder with a lower temperature of the refrigerant gas. This refrigerant heating of the refrigerant causes a smaller amount of inlet refrigerant gas to be introduced into the refrigerant apparatus in the delivery phase and this causes a loss of efficiency of the refrigerant cycle.

It is an object of the present invention to provide an apparatus that will overcome the above described drawbacks.

The technical problem to be solved was to avoid the refrigerant gas absorbing heat in the suction phase in the cylinder. The solution of the technical problem results from a chamber, placed on the delivery portion being formed in the head and the suction muffler being fixed to a suction hole formed in the valve plate in such a way that the refrigerant gas, from the muffler, directly enters the cylinder without having a thermic exchange with the chamber, means being provided to prevent the muffler from rotating about the axes of the hole.

Other details and features of the invention will stand out from the description given below by way of non-limitative example and with reference to the accompanying drawings, in which.

Figure 1:
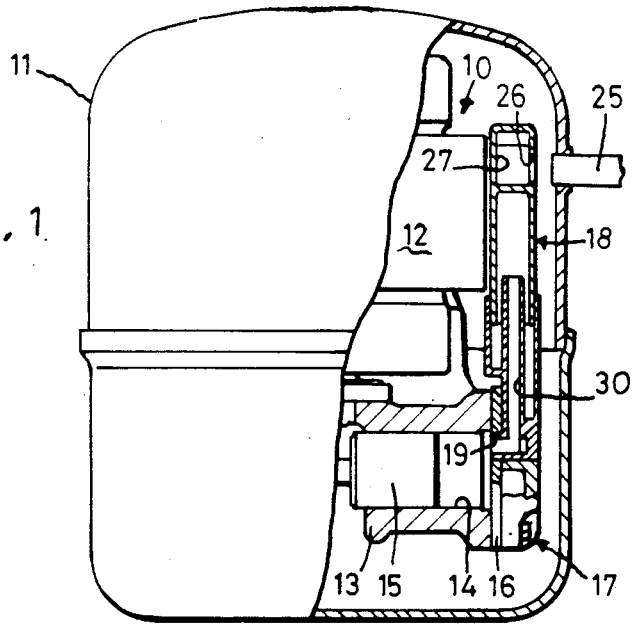
FIG. 1 shows a elevational view of a motor compressor partially in section.
Figure 2:
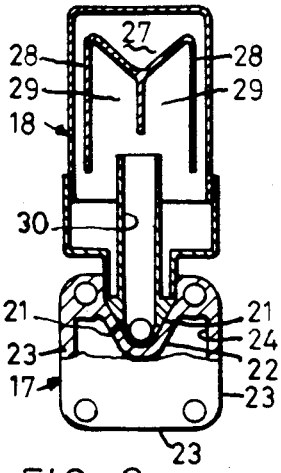
FIG. 2 shows a front view of the suction muffler and of the head.
Figure 3:
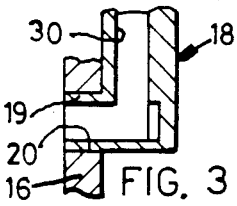
FIG. 3 shows a particular portion of the suction muffler.
Figure 4:
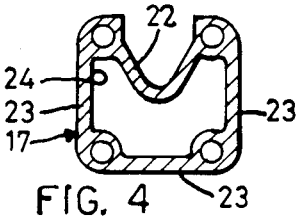
FIG. 4 shows in detail the head of the compressor.

With reference to FIG. 1 a motor compressor unit 10 is enclosed in the hermetically sealed shell 11 in which there is a refrigerant gas. The motor compressor 10 is formed by an electric motor 12, frame 13, a cylinder 14 mounted in frame 13, in which a piston 15 reciprocates, a valve plate 16 positioned at one end of cylinder 14 and a head 17 which fixes the valve plate 16 to the cylinder 14 in a known way. A muffler 18, placed in the suction portion of the unit, presents in its interior (FIGS. 1 and 3) a protuberance 19 which engages the suction hole 20 formed in the valve plate 16 for fixing the muffler 18 to the plate 16. The lower end of the muffler 18 is formed by inclined walls 21 (FIGS. 2 and 4) which are complementary to a perimetrical side 22 of the head 17 in such a way that the muffler 18 is prevented from rotating about the axes of the suction hole 20, rotation being caused by the vibrations of the motor compressor.

The muffler 18 is made of thermically insulating material and resistant to the chemical action of the refrigerant gas and of the lubricating oil for the hereinafter illustrated purposes. The side 22 and the other sides 23 of the head 17 delimit the delivery portion of the chamber 24 in head 17. A pipe 25 which is axially aligned with the hole 26 formed in the muffler 18, carries the refrigerant gas from the vaporizer to the shell 11. The sucked refrigerant gas strikes against the rear wall 27 (FIGS. 1 and 2) and is deviated toward two narrow passages 28. From there, the gas arrives in two expansion chambers 29 and, through a little pipe 30, directly entering the cylinder 14 through the suction valve, not shown in the drawing but known in the art. In this way the refrigerant gas arrives in the cylinder 14 at a low temperature since it does not absorb the heat from the hot parts of the compressor. As above described, the muffler 18 is made of thermically insulating material and is directly connected with the suction hole 20.

Figure 5:
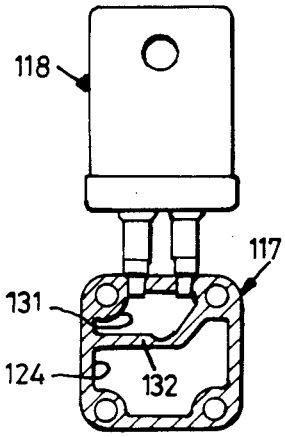
FIG. 5 PRIOR ART
FIG. 5 shows the suction muffler and the head of a known compressor.

This does not occur in the reciprocating motor compressors known in the art as the refrigerant gas passes through the muffler 118 (FIG. 5) and arrives in the suction chamber 131 formed in the head 117, and from there into the cylinder. A wall 132 divides the suction chamber 131 from the delivery chamber 124 so that the heat which spreads in the delivery chamber 124 is transmitted, through the wall 132 to the suction chamber 131.

In such a way the refrigerant gas, which from the muffler 118 arrives in chamber 131, before entering the cylinder absorbs heat and increases its volume and as a consequence the quantity of gas sucked into the cylinder is smaller than the quantity sucked into the cylinder when maintaining the gas at a low temperature. When maintaining the gas at low temperature the gas does not increase its volume.

I claim:

1. A reciprocating hermetically sealed motor compressor unit having a suction portion and a delivery portion comprising a driving electric motor, a frame, a cylinder positioned within said frame, a piston reciprocatable in said cylinder, a valve plate placed at one end of said cylinder and defining a circular suction hole, a head which fixes said valve plate to said frame and a muffler on the suction portion of said unit, said head defining a delivery chamber and said muffler having a portion seated within said circular suction hole, said refrigerant gas, from said muffler directly entering said cylinder without having a thermic exchange with said chamber, said head and muffler defining complementary walls to prevent said muffler from rotating about the axis of said hole and to fix said muffler to said hole, said complementary walls being defined by two inclined walls forming the lower end of said muffler and converging toward said suction hole and a perimetrical side wall formed in said head complementary to said walls of said muffler.

2. The reciprocating hermetically sealed motor compressor according to claim 1, wherein said muffler is made of thermically insulating material.

* * * * *